US006170941B1

(12) United States Patent
Hara et al.

(10) Patent No.: US 6,170,941 B1
(45) **Date of Patent: *Jan. 9, 2001**

(54) INK CARTRIDGE FOR INK-JET RECORDER

(75) Inventors: Kazuhiko Hara; Kouichi Toba; Atsushi Kobayashi, all of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/036,378

(22) Filed: Mar. 6, 1998

(30) Foreign Application Priority Data

Mar. 7, 1997 (JP) ..... 9-070797

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | | |
|---|---|---|---|---|
| 4,771,295 | | 9/1988 | Baker et al. | 347/87 |
| 4,794,409 | | 12/1988 | Cowger et al. | 347/87 |
| 4,931,811 | | 6/1990 | Cowger et al. | 347/87 |
| 4,967,207 | | 10/1990 | Ruder | 347/7 |
| 4,968,998 | | 11/1990 | Allen | 347/7 |
| 5,070,346 | | 12/1991 | Mochizuki et al. | 347/7 |
| 5,119,115 | | 6/1992 | Buat et al. | 347/86 |
| 5,156,472 | | 10/1992 | Suzuki et al. | 400/124 |
| 5,158,377 | | 10/1992 | Suzuki et al. | 400/124 |
| 5,182,581 | | 1/1993 | Kashimura et al. | 347/87 |
| 5,255,019 | | 10/1993 | Mochizuki et al. | 347/7 |
| 5,420,625 | | 5/1995 | Dietl et al. | 347/85 |
| 5,453,771 | | 9/1995 | Waseda | 347/86 |
| 5,488,401 | | 1/1996 | Mochizuki et al. | 347/86 |
| 5,509,140 | | 4/1996 | Koitabashi et al. | 347/87 |
| 5,590,510 | | 1/1997 | Mochizuki et al. | 53/434 |
| 5,633,667 | * | 5/1997 | Miyazawa | 347/86 |
| 5,821,965 | * | 10/1998 | Oda et al. | 347/86 |
| 6,086,193 | * | 7/2000 | Shinada et al. | 347/86 |

FOREIGN PATENT DOCUMENTS

| | | | |
|---|---|---|---|
| 261 764 | | 3/1988 | (EP) . |
| 408 241 | | 1/1991 | (EP) . |
| 488 829 | | 6/1992 | (EP) . |
| 536 980 | | 4/1993 | (EP) . |
| 580 433 | | 7/1993 | (EP) . |
| 581 531 | | 2/1994 | (EP) . |
| 625 424 | | 11/1994 | (EP) . |
| 633 138 | | 1/1995 | (EP) . |
| 640 482 | | 3/1995 | (EP) . |
| 0 665 108 | | 8/1995 | (EP) . |
| 665 108 | | 8/1995 | (EP) . |
| 0 816 101 | | 1/1998 | (EP) . |
| 2 293 142 | * | 3/1996 | (GB) . |
| 2 315 045 | | 1/1998 | (GB) . |
| 55-42874 | | 3/1980 | (JP) . |
| 4-144755 | | 5/1992 | (JP) . |
| 6-15841 | | 1/1994 | (JP) . |

* cited by examiner

*Primary Examiner*—N. Le
*Assistant Examiner*—Michael Nghiem
(74) *Attorney, Agent, or Firm*—Stroock & Stroock & Lavan LLP

(57) ABSTRACT

Generally speaking, in accordance with the invention, an ink cartridge for an ink-jet recording apparatus can include a container formed by a plurality of walls, an ink supply port extending through at least one of said walls of the container to permit ink to pass out of the container, a porous member disposed within the container for transferring ink to the ink supply port, and a projecting member that projects into the container and is formed with an inlet of the ink supply port. The projecting member can engage against and locally compress a portion of the porous member in the region of the inlet of the ink supply port. The projecting member can be formed so that a first region of the container proximal the front wall of the container is shallower than a second region of the container proximal the back wall of the container.

11 Claims, 5 Drawing Sheets

INK CARTRIDGE FOR INK-JET RECORDER

BACKGROUND OF THE INVENTION

The present invention relates to a replenishable ink cartridge for use in an ink-jet printer with a recording head.

A prior art ink jet printer in which an ink-containing unit and an ink jet recording head are mounted on a carriage is disclosed in European Patent Publication No. 581,531. In the disclosed printer, to prevent printing failures caused by fluctuation of ink head pressure or air bubbles due to movement of the ink cartridge caused by the movement of the carriage, the ink container is divided into two regions. A first region of the container adjacent the recording head houses ink impregnated in a porous member, and a second region contains liquid ink without a porous member. This structure enables the ink to be conducted to the recording head via the porous member so that the problems arising from movement of the ink in the cartridge are prevented from occurring to a certain extent.

As shown in FIGS. 8 and 9, to cause the ink absorbed in a porous member 451 to flow into the recording head (not shown) smoothly, a projecting member 452 is formed inside a container body 440 so as to draw ink toward an ink supply inlet 458 of an ink supply port 450 by locally pressing porous member 451 to selectively increase the capillary force.

To improve full-color print quality, on the other hand, an ink-jet recording apparatus has been designed to reduce the granular look of printed material produced by printers of the prior art by using light ink and dark ink to form dots. Such a recording apparatus requires ink of at least six colors: dark magenta, light magenta, dark cyan, light cyan, yellow and black. One problem caused by using an increased number of inks, however, is that the weight of the carriage is increased, which thereby impairs the movement of the carriage and increases the time it takes the carriage to return to a printing position.

To mitigate the aforementioned problems, the weight of the carriage is reduced by decreasing the size of each color's ink cartridge. Consequently, the width of each color in a container body forming the ink cartridge is narrowed to a small dimension. Referring to FIG. 9, as the width of the ink cartridge is narrowed, however, the rigidity of porous member 451 correspondingly increases and a portion 459 of porous member 451 located between a front wall 456 and projecting member 452 is deformed into a V shape, thereby creating a blank space 454. A portion 460 located between projecting member 452 and a back wall 461 creases such that portion 460 is not pressed against projecting member 452, thereby creating a blank space 455. Finally, as is shown in FIG. 8, at a location above projecting member 452, porous member 451 spans the gap from projecting member 452 to a side wall 463 and an internal wall 464, thereby creating a blank spaces 453. Thus, blank spaces 453, 454, 455 are produced because porous member 451 does not fully occupy the space defined by container body 440. Even though spaces 453, 454, 455 may be filled with ink, because spaces 453, 454 and 455 are positioned below ink supply inlet 458, ink stored in such spaces cannot flow to the recording head via ink supply port 480. Thus, spaces 453, 454, 455 waste the ink and also may become bubble reservoirs.

One possible solution to this problem is to join porous member 451 to container body 440 during the manufacturing process. However, to do so requires that porous member 451 be cut to precise specifications, which is a complicated undertaking. Moreover, the supply of ink from those portions of porous material that would occupy spaces 453, 454, 455 in such a construction would be reduced because the portions would not be adequately compressed if joined to the walls of container body 440.

Accordingly, it is desirable to provide an improved ink cartridge that overcomes the drawbacks of the prior art.

SUMMARY OF THE INVENTION

Generally speaking, in accordance with the invention, an ink cartridge for an ink-jet recording apparatus can include a container formed by a plurality of walls, an ink supply port extending through at least one of said walls of the container to permit ink to pass out of the container, a porous member disposed within the container for transferring ink to the ink supply port, and a projecting member that projects into the container and is formed with an inlet of the ink supply port. The projecting member engages against and locally compresses a portion of the porous member in the region of the inlet of the ink supply port. The projecting member is formed so that a first region of the container proximal the front wall of the container is shallower than a second region of the container proximal the back wall of the container.

Further, in a first cross section, the projecting member can have a V-shaped profile at a region proximal to the front wall of the container, a slope region distal to the front wall of the container, and a plateau region containing the ink supply port therebetween. In a second cross section, the projecting member can have a first sloping region and a second sloping region having a plateau region containing the ink supply port therebetween.

Accordingly, it is an object of the invention to provide an improved ink cartridge.

Another object of the present invention is to overcome the foregoing problems by providing an ink cartridge with a porous member that occupies blank spaces within the container body, without requiring the porous member to be cut to a specific shape.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is made to the following description taken in connection with the accompanying drawings in which.

FIG, 8 is a rear elevational cross-sectional view of an ink cartridge of the prior art.

DESCRIPTION OF THE PREFERRED EMBODIMENTS

Figure 1:
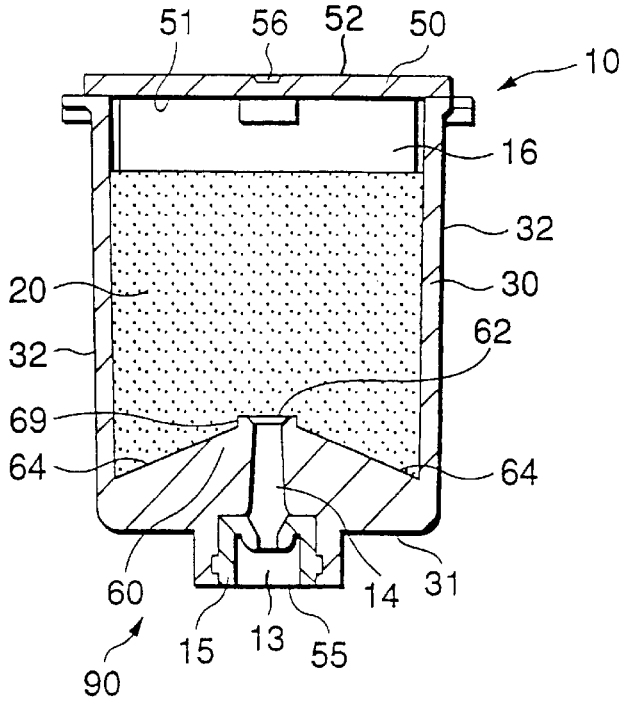
FIG. 1 is a rear elevational cross-sectional view of an ink cartridge constructed in accordance with a first embodiment of the present invention.
Figure 2:
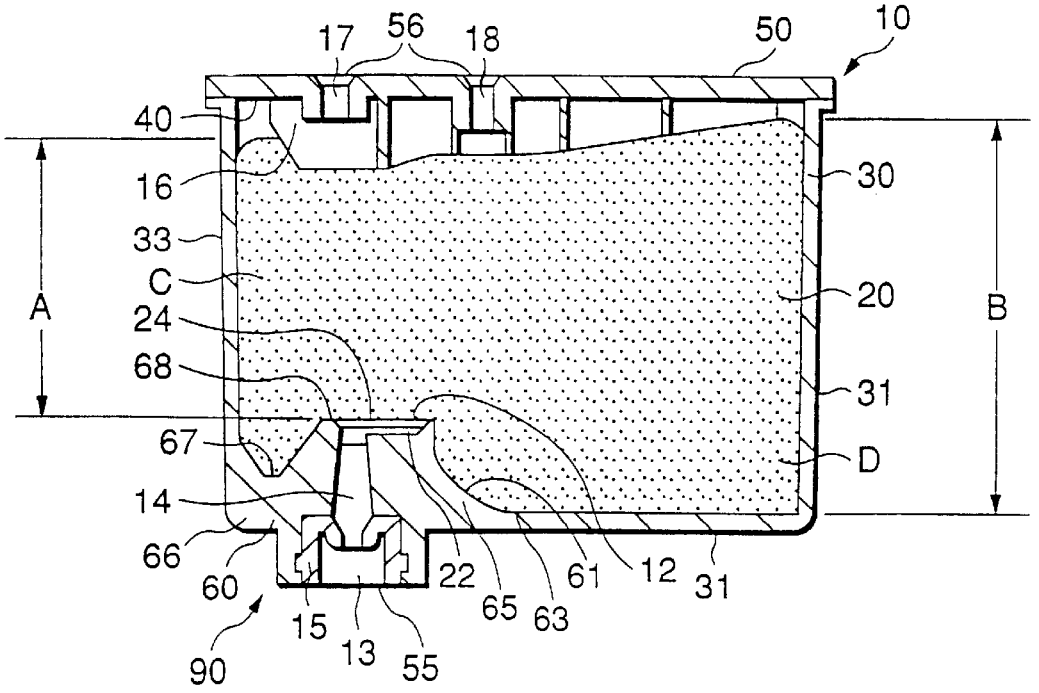
FIG. 2 is a side cross-sectional view of the ink cartridge depicted in FIG. 1.

Referring now to FIGS. 1 and 2, an ink tank cartridge constructed in accordance with a first embodiment of the present invention and generally indicated at 10, is disclosed. Ink cartridge 10 includes a container body 30 formed by a bottom wall 31, two side walls 32 that extend upwardly from bottom wall 31, and a front wall 33 and a back wall 34 that extend upwardly from bottom wall 31 and are positioned between side walls 32. Walls 31, 32, 33 and 34 form an opening 40. Container body 30 also includes an ink supply port 13, 14, which extends through an outwardly projecting portion 90, bottom wall 31, and an inwardly projecting portion 60 to supply ink contained within container body 30 to an ink supply needle of a recording head (not shown).

Container body 30 is designed to accommodate porous member 20, which is made of a resilient material suitable for absorbing ink. The volume of porous member 20 is larger than the volume of container body 30, such that, when porous member 20 is inserted into container body 30, porous member 20 is accommodated in a compressed condition. Preferably, porous member 20 is constructed with a slightly greater length and width than the length and width of opening 40, and a slightly greater height than container body 30.

Ink cartridge 10 also includes a lid 50, having an outer surface 52 and inside surface 51 with ribs 16 formed thereon, for sealing opening 40 of container body 30.

Figure 8:
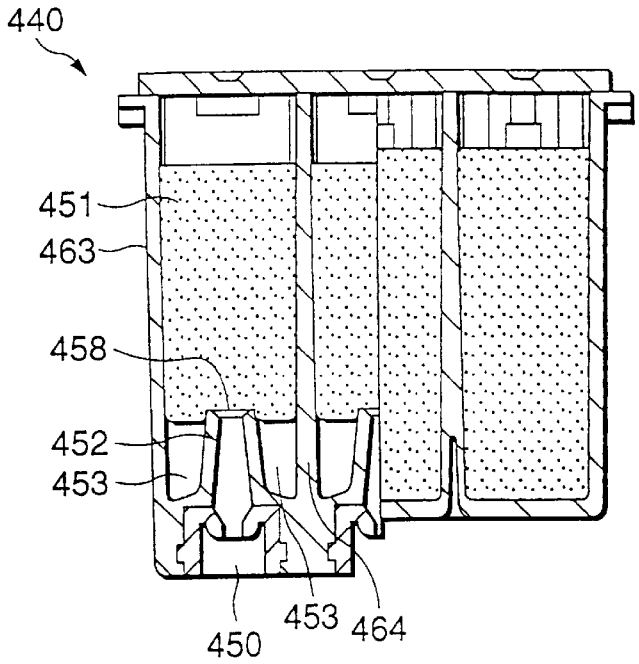
FIG.8 PRIOR ART
Figure 9:
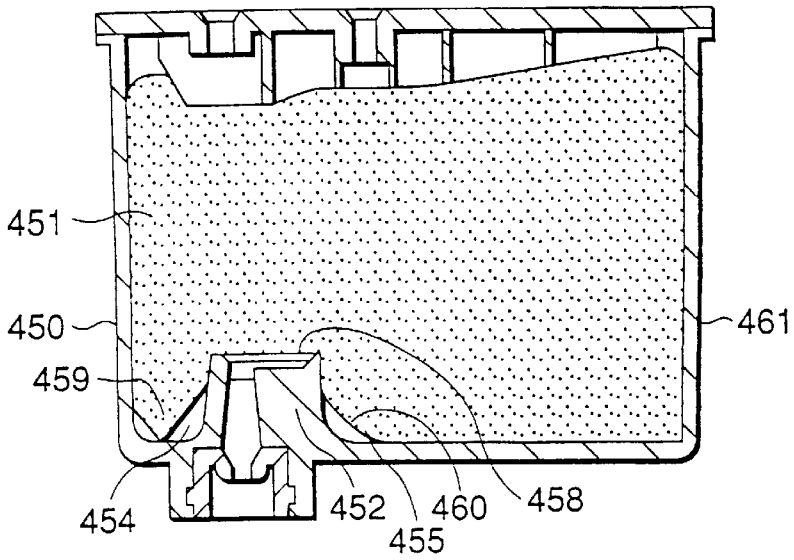
FIG.9 PRIOR ART
FIG. 9 is a side cross-sectional view of the prior art ink cartridge of FIG. 8.

As is shown in FIG. 1, inwardly projecting portion 60 includes a plateau includes a plateau 62, having a plateau top 68, two plateau sides 69 extending downwardly from plateau top 68, and sloped portions 64 that slope downwardly from plateau sides 69 to side walls 32. As such, the dropoff from plateau top includes a plateau 62 to side walls 32 is more gradual than that disclosed in the prior art (see FIG. 8), and porous member 20 is more easily accommodated by sloped portions 64.

Referring to FIG. 2, inwardly projecting portion 60 includes a front portion 66, which is essentially V-shaped in profile, and slopes downwardly from plateau top 68 to a base point 67, at which point front portion 66 slopes upwardly to meet front wall 33, and a back portion 65 with a recess 61, which slopes downwardly from plateau top 68 to meet bottom wall 31 at a point 63. Base point 67 is preferably positioned higher than point 63. As such, the volume of container 30 available to accommodate porous member 20 above front portion 66 is less than the volume of container 30 available to accommodate porous member 20 above back portion 65.

Thus, when porous member 20 is disposed within container body 30, and lid 50 is secured to container body 30, lid 50, ribs 16 and inwardly projecting portion 60 act to compress porous member 20. Referring to FIG. 2, because a first length A measured between plateau top 68 of inwardly projecting portion 60 and rib 16 is less than a second length B measured between bottom wall 31 and rib 16, a shallow region C is formed between plateau top 68 of inwardly projecting portion 60 and rib 16, and a deeper region D is formed between projecting member 60 and back wall 34. Because porous member 20 has a constant height, that portion of porous member 20 contained within shallow region C is compressed more than the portion of porous member 20 contained within deeper region D. As such, recess 61 of back portion 65 accommodates porous member 20 without forming any gap with respect to container 30, and that portion of porous member 20 adjacent front portion 66 of projecting member 60 is deformed and accommodated by front portion 66 such that gaps are not formed between front wall 33 and back portion 65. In this manner, porous member 20 occupies container body 30 such that no blank spaces are produced between projecting member 60 and porous member 20 or between front wall 33 and side walls 32 and porous member 20.

Inwardly projecting portion 60 includes an ink supply port portion 14, which terminates in an ink inlet 22 extending in the longitudinal direction and formed in plateau top 68, outwardly projecting portion 90 includes an ink supply portion 13 for supplying ink contained in container body 30 to an ink supply needle (not shown), ink inlet 22 and ink supply port portion 13. A packing member 15 is inserted into ink supply port portion 14 such that packing member 15 forms a fluid-tight fit with the ink supply needle (not shown) when the ink supply needle is inserted into ink supply port portion 13. A filter 12, preferably made of a mesh material, is fuse-bonded to cover ink inlet 22.

Ink supply portion 13 is sealed with a film 55 so as to accommodate porous member 20 in container body 30 in a negative pressure environment. Preferably, ink supply port portion 13 is sealed after porous member 20 and ink are inserted into container body 30. To supply ink to container body 30, a supply needle (not shown) is inserted into an ink injection port 17 formed in lid 50 proximate front portion 66, and then an exhaust needle (not shown) is inserted into a space formed adjacent ribs 16 through an exhaust throughhole 18 formed in lid 50, so that porous member 20 absorbs a predetermined quantity of ink as the air is exhausted. A sealing film 56 is fused to outer surface 52 of lid 50 at the state when ink has been injected into container body 30.

Figure 3:
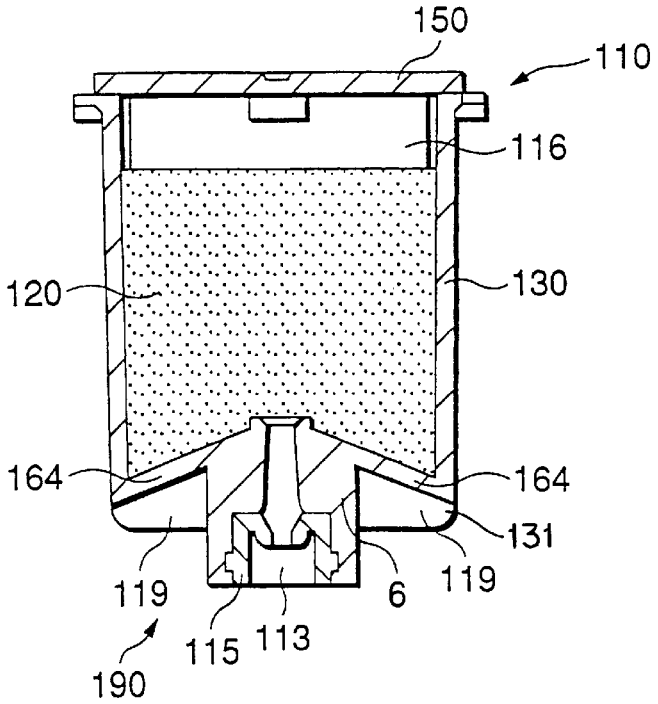
FIG. 3 is a rear elevational cross-sectional view of an ink cartridge constructed in accordance with a second embodiment of the present invention.
Figure 4:
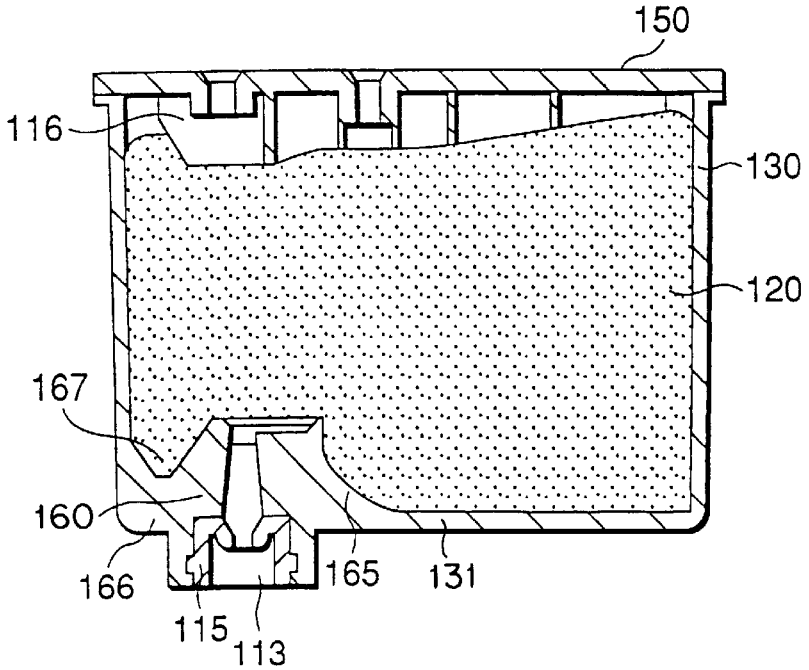
FIG. 4 is a side cross-sectional view of the ink cartridge depicted in FIG. 3.

Referring to FIGS. 3 and 4, an ink tank cartridge 110 constructed in accordance with a second embodiment of the invention is depicted. Ink tank cartridge 110 of this embodiment differs from the first embodiment in that the weight of ink cartridge 110 may be reduced by forming hollow portions 119 in bottom wall 131 and inwardly projecting portion 160, the inner side walls of said hollow portions 119 being essentially aligned with the side walls of outwardly projecting portion 190, thereby facilitating high-speed printing.

Figure 5:
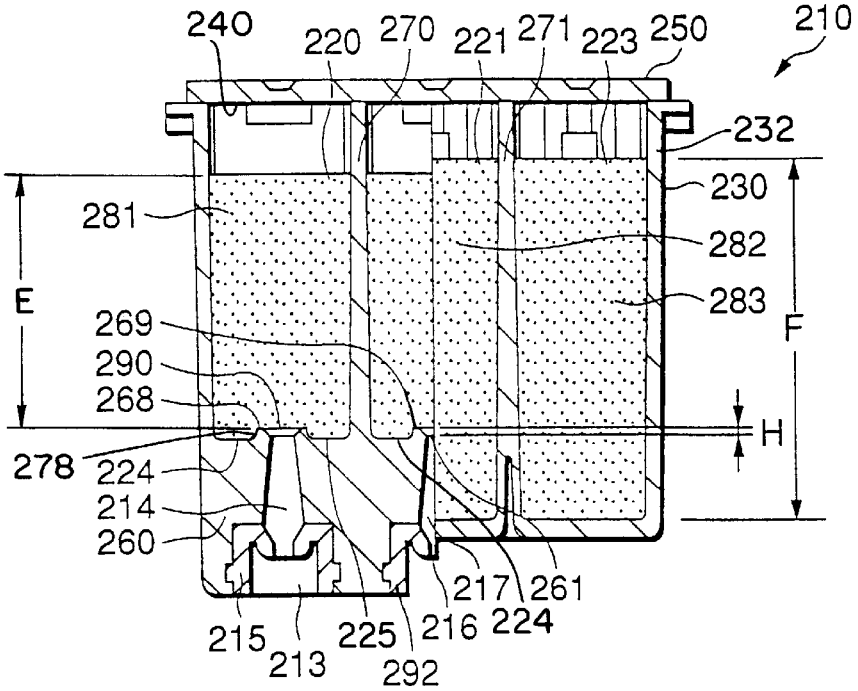
FIG. 5 is a rear elevational cross-sectional view of an ink cartridge constructed in accordance with a third embodiment of the present invention.
Figure 6:
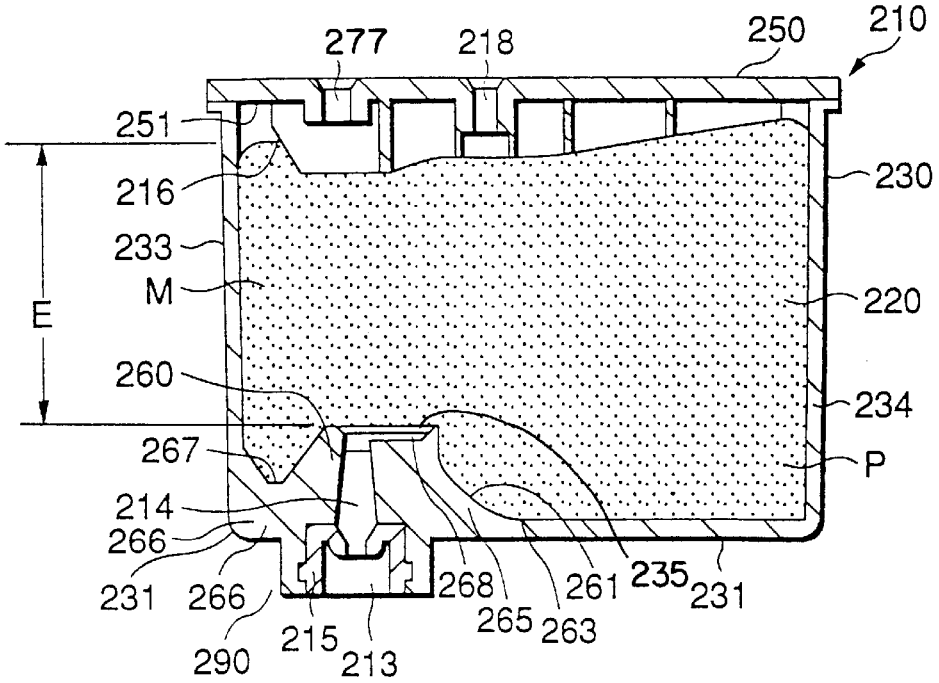
FIG. 6 is a side cross-sectional view of the ink cartridge depicted in FIG. 5.

Reference is now made to FIGS. 5 and 6, which disclose an ink tank cartridge constructed in accordance with a third embodiment of the invention, wherein similar reference numerals indicate similar structure. An ink cartridge 210 includes a container body 230 formed by a bottom wall 231, two side walls 232 that extend upwardly from bottom wall 231, and a front wall 233 and a back wall 234 that extend upwardly from bottom wall 231 and are positioned between side walls 232. Walls 231, 232, 233 and 234 form an opening 240. Unlike the first embodiment, container body 230 includes at least two partition walls 270, 271, which divide container body 230 into three chambers 281, 282, 283 for accommodating porous members 220, 221, 223.

Chambers 281, 282, 283 respectively include inwardly projecting portions of which 260 and 261, respectively, are shown, and which are preferably integral with the walls of the respective chambers 281, 282, 283. Chambers 281, 282, 283 also include ink supply partitions and ports, of which 213, 214 and 216, 217 are respectively shown. Ink supply portions 213, 214 and ink supply ports 216, 217 extend, respectively, through upwardly projecting portions 260, 261 and outwardly projecting portions 290, 291, to supply ink contained within chambers 281, 282, 283 to ink supply needles (not shown). Ink supply port portions 214, 217 respectively terminate in an ink inlet, of which only 225 is shown, extending in the longitudinal direction formed in the respective plateau top, of which 268, 269 are shown.

Referring to FIG. 5, each inwardly projecting portion 260, 261 includes a plateau top 268, 269 and two short plateau sides 272, 277, respectively, each extending downwardly from plateau top 268, 269 to plane portions 224, 225. Plateau top 268, 269 are formed proximal to ink supply portions 214, 217 and extend upwardly from plane portion 224 a distance H, such that porous members 220, 221, 223 are compressed when inserted into chambers 281, 282, 283, and blank space is not produced between porous members 220, 221, 223, and plane portions 224, 225 and plateau top 268, 269.

Referring to FIG. 6, projecting member 260 includes a front portion 266, which has an essentially V-shaped cross-sectional profile having a low point 267 and is proximal front wall 233, and a back portion 265 with a recess 261, which slopes downwardly from plateau top 268 to meet bottom wall 231 at a point 263, and is proximal back wall 234. Low point 267 and plane portions 224, 225 are preferably positioned higher than point 263. As such, the container volume available to accommodate porous member 220 above front portion 266 and above plateau top 268 is less than the container volume area available to accommodate porous member 220 above back portion 265.

Ink supply port portions 213, 214 receives packing member 215, 292. An ink injection port 277 and an exhaust throughhole 218 are formed in lid 250, each of which is constructed similarly to their counterparts described above in connection with the first embodiment.

Thus, when porous member 220 is disposed within chamber 281, and lid 250 is secured to the container body, lid 250, ribs 216 formed on an inner surface 251 of lid 250, and projecting member 260 act to compress porous member 220. Referring to FIGS. 5 and 6, because a first length E measured between projecting member 260 and rib 216 is less than a second length F measured between bottom wall 231 and rib 216, a shallow region M is formed between projecting member 260 and front wall 233, and a deeper region P is formed between projecting member 260 and rib 216. Because porous member 220 has a constant height, that portion of porous member 220 contained within shallow region M is compressed more than the portion of porous member 220 contained within deeper region P. As such, recess 261 of back portion 265 accommodates porous member 220 without forming any empty space with respect to chamber 281, and that portion of porous member 220 adjacent front portion 266 of projecting member 260 is deformed and accommodated by front portion 266 such that blank space is not formed between front wall 233 and back portion 265. In this manner, porous member 220 occupies the container body such that no blank spaces are produced between projecting member 260 and porous member 220 or between front wall 233 and side walls 232 and porous member 220.

Accordingly, when chamber 281 thus constructed is loaded with porous member 220, a region of the porous member 220 opposite ink supply port 214 is most strongly compressed by projecting member 260 and plateau top 268 formed thereon. As such, porous member 220 is prevented from being deformed at an extreme angle, and no blank space is produced between the container body and porous member 220. Further, the region dislocated by plateau top 268 is deformed along the bottom of chamber 281 along front portion 266 and back portion 265 such that porous member 220 is accommodated in chamber 281 without forming blank space.

In this manner, porous members 220, 221, 223 occupy chambers 281, 282, 283 of container body 230, respectively, such that no blank space is produced between projecting member 260 and porous member 220 or between front wall 233 and side walls 232 and porous member 220.

Figure 7:
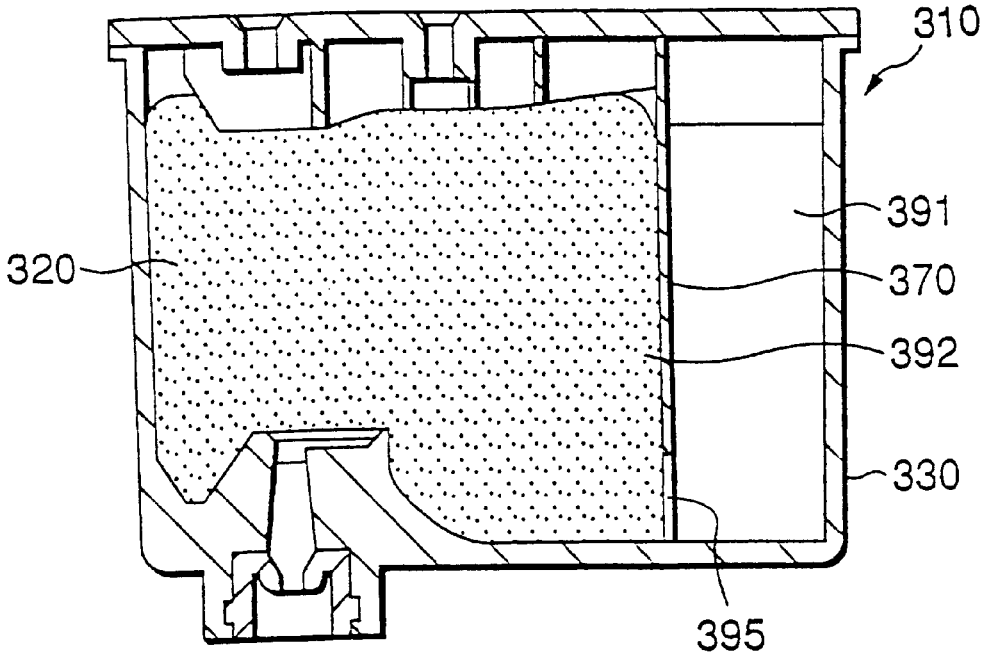
FIG. 7 is a side cross-sectional view of the ink cartridge constructed in accordance with a fourth embodiment of the present invention.

While the foregoing description has focused on a cartridge with ink contained in chambers having porous members by way of example, the present invention is also applicable with the same effect to an ink cartridge having one chamber for holding ink and a second chamber containing a porous member. Such an embodiment is shown in FIG. 7, wherein ink cartridge 310 includes a container body 330 divided into an ink chamber 391 and a foam chamber 392 by means of a partition wall 370 having a through-hole 395 in the lower portion of wall 370. Ink is contained in porous member 320 within foam chamber 392, and ink chamber 391, and ink is supplied via porous member 320 to a recording head (not shown).

Although a description has been given of the case where the ink supply port is vertically positioned and connected to the recording head in the aforesaid embodiments of the present invention it is understood that the effect is also achieved by horizontally positioning the ink supply port and connecting it to the recording head because ink may be introduced into the ink supply port by the capillary force of the porous material.

It will thus be seen that the objects set forth above, among those made apparent from the preceding description are efficiently obtained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ink tank cartridge for an ink-jet type recording apparatus, comprising:

a plurality of walls forming a chamber Within said ink tank cartridge, including first, second, third, fourth, and fifth walls, said second wall being located opposite said fourth wall, said third wall being located opposite said fifth wall, said third and fifth walls being spaced apart and extending between said second and fourth walls;

an ink supply port extending through said first wall of said chamber to permit ink to pass out of said chamber to the exterior of the ink cartridge and including an inlet in said chamber;

a porous member disposed within said chamber for transferring ink to said I supply port; and a projecting member incorporating a portion of said ink supply port, projecting into said chamber in a projection direction, and defining said inlet to said ink supply port, said projecting member engaging against and at least locally compressing a portion of said porous member in the region of the inlet to said ink supply port, said projecting member being positioned closer to said second wall than to said fourth wall of said chamber, said projecting member including at least first and second projecting portions, said first projecting portion extending from said ink supply port at least in part in a direction lateral to said projection direction so as to abuttingly engage one of said second, third, and fifth walls, said second projecting portion extending from said ink supply port at least in part in a direction lateral to said projection direction so as to abuttingly engage one of said second, third, and fifth walls, said second projecting portion extending to, and abuttingly engaging, a different wall from said first projecting portion, wherein said porous member is in continuous contact with said first projecting portion and said second projecting portion.

2. The ink tank cartridge of claim 1, further comprising a third projecting portion extending from said ink supply port at least in part in a direction lateral to said projection direction so as to abuttingly engage one of said second, third, and fifth walls, said third projecting portion extending to, and abuttingly engaging, a different wall from said first and second projecting portions.

3. The ink cartridge of claim 2, wherein said first, second and third projecting portions and said first wall all have surfaces defining in part the interior of said chamber, the region of said projecting member defining the inlet to said ink supply port further defining the end of said projecting member, the maximum distance measured in said projection direction from the end of said projecting member to the surface of each of said first, second and third projecting portions being less than the maximum distance from the end of said projecting member to the surface of said first wall.

4. The ink cartridge of claim 3, wherein the surfaces of said second and third projecting portions extend from adjacent said top of said projecting member to said third and fifth walls, respectively, each sloping in a direction away from said top of said projecting member.

5. The ink cartridge of claim 2, said projecting member including a fourth projecting portion extending at least in part in a direction lateral to said projection direction toward but not reaching said fourth wall, said fourth projecting portion having, in part, an inclined surface defining in part the interior of the chamber.

6. The ink cartridge of claim 2, wherein said second projecting portion has a surface defining in part the interior of the chamber, the region of said projecting member defining said supply port inlet defining the top of said projecting member, said surface of said second projecting portion extending from adjacent the top of said projecting member to said third wall, sloping in a direction away from said top of said projecting member.

7. The ink cartridge of claim 1, wherein said first and second projecting portions and said first wall all have surfaces defining in part the interior of said chamber, the region of said projecting member defining the inlet to said ink supply port further defining the end of said projecting member, the maximum distance measured in said projection direction from the end of said projecting member to the surface of each of said first and second projecting portions being less than the maximum distance from the end of said projecting member to the surface of said first wall.

8. The ink cartridge of claim 1, including a plurality of said chambers formed integrally, each chamber having an ink supply port and at least one of said projecting members.

9. The ink cartridge of claim 1, wherein said first projecting portion extends to, and abuttingly engages, said third wall, and said second portion projecting extends to, and abuttingly engages, said fifth wall.

10. An ink tank cartridge for an ink jet type recording apparatus, comprising:

a container body having a plurality of walls forming a chamber within said ink tank cartridge, including first, second, third, fourth, and fifth walls, said second wall being located opposite said fourth wall, said third wall being located opposite said fifth wall, said third and fifth walls being spaced apart and extending between said second and fourth walls;

an ink supply port extending through said first wall of said chamber to permit ink to pass out of said chamber to the exterior of the ink cartridge and including an inlet in said chamber;

a porous member disposed within said chamber; and a projecting member incorporating a portion of said ink supply port, projecting into said chamber in a projection direction, and defining an inlet to said ink supply port, said projecting member being positioned closer to said second wall than to said fourth wall of said chamber, wherein said projecting member having at least one projecting portion defining a sloped surface, wherein said sloped surface is inclined with respect to said first wall, extends at least in part in a direction lateral to said projection direction toward at least one of said third, fourth, and fifth walls, connects said inlet to said first wall, and is in continuous contact with said porous member.

11. The ink tank cartridge as set forth in claim 10, wherein said projecting member is positioned closer to said, third and fifth walls than to said fourth wall, and said sloped surface extends from said ink supply port towards said fourth wall.

* * * * *